United States Patent [19]

Kato et al.

[11] 4,168,165

[45] Sep. 18, 1979

[54] ELECTROPHOTOGRAPHIC PHOTOSENSITIVE MATERIAL SUITABLE FOR OFFSET PRINTING AND LITHOGRAPHY AND PROCESS FOR PRODUCTION THEREOF

[75] Inventors: Yoshiaki Kato, Neyagawa; Akira Fushida, Suita; Yasuo Ueda, Kobe; Yasusuke Tohi, Sakai; Tatsuo Aizawa, Osaka, all of Japan

[73] Assignee: Mita Industrial Company Limited, Osaka, Japan

[21] Appl. No.: 794,130

[22] Filed: May 5, 1977

[30] Foreign Application Priority Data

May 15, 1976 [JP] Japan ..... 51-54826

[51] Int. Cl.[2] ..... G03G 5/087; G03G 5/14

[52] U.S. Cl. ..... 96/1.8; 96/33; 96/1.5 R; 101/453

[58] Field of Search ..... 96/1.8, 1 R, 33, 87, 96/1.5

[56] References Cited

U.S. PATENT DOCUMENTS

| | | | |
|---|---|---|---|
| 3,733,200 | 5/1973 | Takaishi et al. | 96/33 X |
| 3,753,709 | 8/1973 | Staudenmayer et al. | 96/33 X |
| 3,804,668 | 4/1974 | Bakule et al. | 96/1.8 X |
| 3,847,606 | 11/1974 | Schwartz et al. | 96/1.5 |
| 4,015,985 | 4/1977 | Jones | 96/1.8 |

*Primary Examiner*—Roland E. Martin, Jr.
*Assistant Examiner*—John L. Goodrow
*Attorney, Agent, or Firm*—Sherman & Shalloway

[57] ABSTRACT

An electrophotographic photosensitive material suitable for offset printing and lithography comprising a flexible substrate, an electroconductive back coat layer formed on one surface of the substrate, an electroconductive intermediate layer formed on the other surface of the substrate and a photoconductive layer formed on the intermediate layer, said photoconductive layer being composed of a fine powder of a photoconductor dispersed in an electrically insulating resin, wherein said intermediate layer is composed of a composition comprising (A) an acrylic resin, (B) a vinyl acetate polymer having a degree of polymerization of 100 to 1700 and (C) a resinous conducting agent, in said composition the weight ratio of acrylic resin (A)/vinyl acetate polymer (B) is in the range of 4/1 to 10/1 and the amount of the conducting agent (C) is 20 to 100 parts by weight per 100 parts by weight per 100 parts by weight of the sum of the components (A) and (B), said intermediate layer has such a multi-layer distribution structure that a combination of the vinyl acetate polymer and the acrylic resin is predominantly distributed in the surface portion falling in contact with the photoconductive layer, and the photoconductive layer is bonded to the intermediate layer through said surface portion.

11 Claims, 1 Drawing Figure

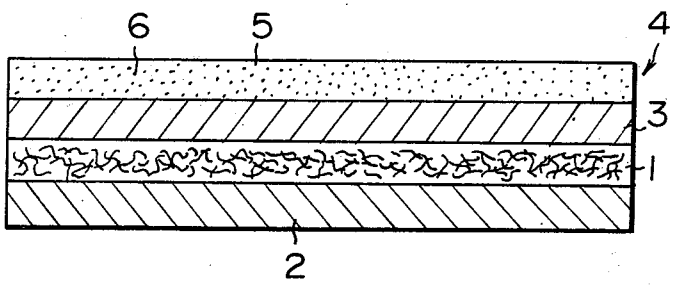
6
5
4
3
1
2

ELECTROPHOTOGRAPHIC PHOTOSENSITIVE MATERIAL SUITABLE FOR OFFSET PRINTING AND LITHOGRAPHY AND PROCESS FOR PRODUCTION THEREOF

BACKGROUND OF THE INVENTION (1) Field of the Invention

This invention relates to an electrophotographic photosensitive material suitable for offset printing and lithography and a process for the preparation thereof. More particularly, the invention relates to an electrophotographic photosensitive material for offset printing and lithography in which a novel multi-layer distribution structure is formed in an intermediate layer interposed between a flexible substrate and a photoconductuve layer.

(2) Description of the Prior Art

Plates in which an oleophilic ink-supporting portion corresponding to an image to be printed and a hydrophilic ink-repelling portion corresponding to a non-image area, i.e., the background, are formed on a suitable water-resistant substrate have heretofore been broadly used for offset printing or lithography.

Further, processes for preparing these printing plates according to electrophotography have been known from old. According to these known processes, an electrophotograhic photosensitive material comprising a flexible substrate, an electroconductive back coat layer formed on one surface of the flexible substrate, an electroconductive intermediate layer formed on the other surface of the substrate and a photoconductive layer formed on the intermediate layer is passed through a series of the steps of charging, imagewise exposure, development and fixation to form a fixed image of toner particles on the photoconductive layer, and then the photoconductive layer of the photosensitive material is treated with an etching solution to render hydrophilic a fine powder of an inorganic photoconductor contained in the photoconductive layer, whereby an oleophilic ink-supporting portion corresponding to the area of the fixed image of toner particles and a hydrophilic ink-repelling portion corresponding to the non-image area are formed.

Known electrophotographic photosensitive materials, however, are still insufficient in a combination of the sharpness of an image and the resistance to the printing operation when they are used as plates for offset printing or lithography. For example, in order to form a clear and sharp toner image, the intermediate layer of an electrophotographic photosensitive material is required to be sufficiently electroconductive, but in order to improve the resistance to the printing operation, the intermediate layer is required to show a sufficient moisture-resistant adhesion at the etching or printing step. In general, resinous compositions having a high electroconductivity are poor in the moisture-resistant adhesion, whereas resinous compositions having a high moisture-resistant adhesion are poor in the electroconductivity. Accordingly, any of known resinous compositions can hardly satisfy the foregoing two requirements similtaneously.

In electrophotographic photosensitive materials heretofore used for production of plates for offset printing or lithography, a composition comprising (1) a cationic or anionic resinous conducting agent and (2) a water-soluble or water-dispersible resin is used as the resinous composition for the intermediate layer. However, this composition is still insufficient in the combination of the electroconductivity and the moisture-resistant adhesion.

BRIEF SUMMARY OF THE INVENTION

We found that when a composition comprising (A) an acrylic resin and (B) a vinyl acetate polymer at an (A)/(B) weight ratio of from 4/1 to 10/1 and further comprising (C) a resinous conducting agent in an amount of 20 to 100 parts by weight per 100 parts by weight of the sum of the components (A) and (B) is coated in the form of a solution in an aqueous medium as an intermediate layer on a flexible substrate, there is formed an intermediate layer having such a multi-layer distribution structure that the vinyl acetate polymer or a combination of the vinyl acetate polymer and the acrylic resin (sometime referred to as "polymer-resin combination" hereinafter) is predominantly distributed in the surface portion, and that when a photoconductive layer is bonded to the intermediate layer through this surface portion in which the vinyl acetate polymer or polymer-resin combination is predominantly distributed, the moisture-resistant adhesion between the two layers can be remarkably improved while maintaining the electroconductivity of the intermediate layer at a high level.

It is therefore a primary object of the present invention to provide an electrophotographic photosensitive material especially suitable for production of plates for offset printing or lithography, which comprises an intermediate layer excellent in the combination of the electroconductivity and moisture-resistant adhesion.

Another object of the present invention is to provide an electrophotographic photosensitive material which is excellent in the combination of the sharpness of a printed image and the resistance to the printing operation when used for offset printing or lithography.

Still another object of the present invention is to provide an electrophotographic photosensitive material which can form a clear ink-supporting portion precisely agreed with an image pattern to be printed, when developed with a one-component toner, i.e., an electroconductive magnetic developer.

In accordance with one fundamental aspect of the present invention, there is provided an electrophotographic photosensitive material suitable for offset printing and lithography comprising a flexible substrate, an electroconductive back coat layer formed on one surface of the substrate, an electroconductive intermediate layer formed on the other surface of the substrate and a photoconductive layer formed on the intermediate layer, said photoconductive layer being composed of a fine powder of a photoconductor dispersed in an electrically insulating resin, wherein said intermediate layer is composed of a composition comprising (A) an acrylic resin, (B) a vinyl acetate polymer having a degree of polymerization of 100 to 1700 and (C) a resinous conducting agent, in said composition the weight ratio of acrylic resin (A)/vinyl acetate polymer (B) is in the range of 4/1 to 10/1 and the amount of the conducting agent (C) is 20 to 100 parts by weight per 100 parts by weight of the sum of the components (A) and (B), said intermediate layer has such a multi-layer distribution structure that a combination of the vinyl acetate polymer and the acrylic resin is predominantly distributed in the surface portion falling in contact with the photoconductive layer, and the photoconductive layer is bonded to the intermediate layer through said surface portion.

In accordance with another aspect of the present invention, there is provided a process for the preparation of electrophotographic photosensitive materials suitable for offset printing and lithography, which comprises forming an electroconductive back coat layer on one surface of a flexible substrate, coating the other surface of the substrate with a coating composition comprising (A) a water-soluble acrylic resin, (B) a vinyl acetate polymer having a degree of polymerization of 100 to 1700 and (C) a conducting agent at an (A)/(B) weight ratio of from 4/1 to 10/1 and an [(A)+(B)]/(C) weight ratio of from 100/20 to 100/100, components (A), (B) and (C) being dispersed in a mixed solvent of water and a water-miscible organic solvent, drying the composition coated on the substrate to form an intermediate layer having such a multi-layer distribution structure that a combination of the vinyl acetate polymer and the acrylic resin is predominantly distributed in the surface portion, and coating a composition formed by dispersing a fine powder of a photoconductor in a solution of an electrically insulating resin in an aromatic solvent, on the so formed intermediate layer and drying the coated composition.

BRIEF DESCRIPTION OF THE DRAWING

FIG. 1 is a view illustrating diagrammatically the section of the electrophotographic photosensitive material of the present invention.

DETAILED DESCRIPTION OF THE PREFERRED EMBODIMENTS

Referring now to FIG. 1 illustrating diagrammatically the section of the electrophotographic photosensitive material of the present invention, the electrophotographic photosensitive material comprises a flexible support 1, an electroconductive back coat layer 2 formed on one surface of the flexible substrate 1, an electroconductive intermediate layer 3 formed on the other surface of the flexible substrate 1 and a photoconductive layer 4 formed on the intermediate layer 3. Since the surface of the photoconductive layer 4 is to be rendered hydrophilic by the etching treatment, the photoconductive layer 4 is made up of a fine powder 6 of a photoconductor dispersed in an electrically insulating resin binder 5.

According to the present invention, the intermediate layer 3 is formed from a composition comprising at a specific weight ratio (A) an acrylic resin, (B) a vinyl acetate polymer having a degree of polymerization of 100 to 1700 and (C) a resinous conducting agent, and a novel multi-layer distribution structure is formed in this intermediate layer 3.

A combination of any two components of the three components (A), (B) and (C) that are used for formation of the intermediate layer in the present invention, namely the combination of (A)-(B), (A)-(C) or (B)-(C), can form a homogeneous solution or dispersion in an aqueous medium, but the combination of the three components merely forms a heterogeneous solution or dispersion in an aqueous medium in which phase separation readily takes place. In the present invention, this characteristic property of the combination of the three components (A), (B) and (C) is skillfully utilized. More specifically, a composition formed by dissolving or dispersing the above three resinous components (A), (B) and (C) in an aqueous medium is coated on the surface of a flexible substrate and is then dried to form a multi-layer distribution structure in which a combination of the vinyl acetate polymer (B) and the acrylic resin (A) is predominantly distributed in the surface portion.

When an acrylic resin (A) alone is used as the non-electroconductive resin binder, it is difficult to attain a sufficient bonding between the intermediate layer and a photoconductive layer formed thereon afterwards, and if a vinyl acetate polymer (B) alone is used, the electroconductivity of the intermediate layer is insufficient and the coating property and electric characteristics of the intermediate layer are drastically degraded. In the present invention, in order to improve the electroconductivity of the intermediate layer and the moisture resistance of the bonding between the intermediate layer and the photoconductive layer, it is important that the acrylic resin (A) and the vinyl acetate polymer (B) should be used in such amounts that the (A)/(B) weight ratio is in the range of from 4/1 to 10/1, preferably from 5/1 to 8/1.

In order to attain the objects of the present invention, it also is important that the resinous conducting agent (C) should be used in an amount of 20 to 100 parts by weight, preferably 50 to 70 parts by weight, per 100 parts by weight of the sum of the acrylic resin (A) and the vinyl acetate polymer (B). If the amount of the resinous conducting agent (C) is smaller than in the above range, so-called fogging is caused when an image is formed according to the electrophotographic process and the image becomes indefinite. If the amount of the conducting agent (C) is larger than in the above range, the adhesion, especially the moisture-resistant adhesion, between the intermediate layer and the photoconductive layer is reduced.

In the present invention, it is preferred that the acrylic resin and vinyl acetate polymer that are used be water-soluble or water-dispersible when coated but be water-insoluble after coating and drying.

As the acrylic resin (A), there are employed acrylic resins which show a water-soluble characteristic only when neutralized with alkaline substances, especially ammonia. As a preferred example of such acrylic resin, there can be mentioned an acrylic resin having an acid value of at least 39, especially 50 to 85, which is composed of (i) at least one member selected from ethylenically unsaturated carboxylic acids such as acrylic acid, methacrylic acid, crotonic acid, maleic acid and fumaric acid and (ii) at least one member selected from esters of said ethylenically unsaturated carboxylic acids such as ethyl acrylate, ethyl $\beta$-hydroxyacrylate, methyl methacrylate, ethyl methacrylate, ethyl $\beta$-hydroxymethacrylate and 2-ethylhexyl acrylate and olefinic hydrocarbons such as ethylene, propylene, styrene and butadiene. Acrylic acid/ethyl acrylate/methyl methacrylate copolymers and maleic acid/styrene copolymers are especially preferred.

The molecular weight of such acrylic resin is not particularly critical, and it is sufficient that the acrylic resin has a so-called film-forming molecular weight. In general, it is preferred that the acrylic resin be used in the form of a water-soluble ammonium salt, because an acrylic resin in the form of an ammonium salt is readily rendered water-insoluble only by expelling ammonium by drying.

The vinyl acetate polymer (B) that is used in the present invention has a degree of polymerization of 100 to 1700, especially 200 to 1000. When the degree of polymerization is too low, at the step of forming a photoconductive layer by coating, the vinyl acetate polymer is incorporated in the photoconductive layer to reduce electric characteristics of the photoconductive layer. If the degree of polymerization of the vinyl acetate polymer is too high, the property of bonding the photoconductive layer tightly to the intermediate layer becomes insufficient. It is preferred that the vinyl acetate polymer be used in the form of a solution in a water-miscible organic solvent such as methanol. It can also be used in the form of an aqueous emulsion.

As the resinous conducting agent, there may be employed known anionic resinous conducting agents, for example, resinous conducting agents of the carboxylic acid, sulfonic acid and phosphonic acid types, but in general, use of cationic polymeric conducting agents is preferred. As the cationic conducting agent, there are especially preferably employed polymers containing a quaternary ammonium group in an amount of 200 to 1400 meq per 100 g of the polymer, especially 400 to 1000 meq per 100 g of the polymer. Suitable examples of such polymers are as follows:

(1) Resins having a quaternary ammonium group in an aliphatic main chain, for example, quaternized polyethyleneimines consisting of recurring units represented by the following formula:

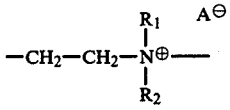

wherein $R_1$ and $R_2$ each stand for a lower alkyl group such as a methyl group, and A is a monovalent low-molecular-weight anion, and di-tertiary amine-dihalide condensates such as ionene.

(2) Resins having an integrated quaternary ammonium group in a cyclic main chain, for example, polypyrazines, quaternized polypiperazines, poly(-dipyridyl), and condensates of 1,3-di-4-pyridylpropane with a dihaloalkane.

(3) Resins having a quaternary ammonium group on a side chain, for example, polyvinyl trimethyl ammonium chloride and polyallyl trimethyl ammonium chloride.

(4) Resins having on a cyclic main chain a branched quaternary ammonium group, for example, resins having recurring units represented by the following formula:

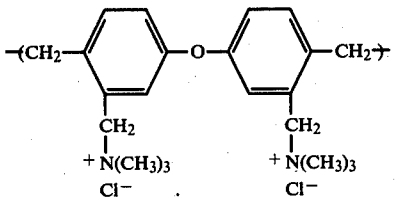

(5) Resins having a quaternary ammonium group on a cyclic side chain, for example, poly(vinylbenzyltrimethyl ammonium chloride).

(6) Resins having a quaternary ammonium side chain on an acrylic skeleton, for example, quaternary acrylic esters such as poly(2-acryloxyethyltrimethyl ammonium chloride) and poly(2-hydroxy-3-methacryloxypropyltrimethyl ammonium chloride) and quaternary acrylamides such as poly(N-acrylamido-propyl-3-trimethyl ammonium chloride).

(7) Resins having a quaternary ammonium group on a hetero-cyclic side chain, for example, poly(N-methylvinyl pyridium chloride) and poly(N-vinyl-2,3-dimethyl imidazolium chloride).

(8) Resins having a quaternary ammonium group on a hetero-cyclic main chain, for example, poly(N,N-dimethyl-3,5-methylene piperidinium chloride) and copolymers thereof.

In addition to the foregoing resins having a quaternary ammonium group on the main chain or side chain, in the present invention, resins having a sulfonium group

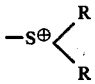

or phosphonium group,

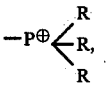

on the main chain or side chain, such as poly(2-acryloxyethyldimethyl sulfonium chloride) and poly(glycidyltributyl phosphonium chloride), can be used as the cationic electroconductive resin.

Since the cationic electroconductive resin that is used in the present invention has a strongly basic group such as a quaternary ammonium group, a sulfonium group or a phosphonium group on the main chain or side chain. it has a low-molecular-weight monovalent anion as the counter ion. The electric resistance of the cationic electroconductive resin is considerably influenced by the kind of this counter ion. As suitable examples of the counter ion, a chloride ion, acetic ion, a nitric ion and a bromide ion can be mentioned in the order of importance.

According to the present invention, a coating composition is formed by dispersing the above-mentioned water-soluble acrylic resin (A), vinyl acetate polymer (B) and resinous conducting agent (C) in a mixed solvent comprising (a) water and (b) a water-miscible organic solvent, and this coating composition is coated on the surface of a flexible substrate. When water alone or a water-miscible organic solvent alone is used as the solvent for dispersing the three components therein, it is difficult to manifest a multi-layer distribution structure specified in the present invention in an intermediate layer, and especially when water alone is employed, the moisture-resistant adherence between the intermediate layer and photoconductive layer cannot be improved. Further, when only a water-miscible organic solvent such as methanol is employed, electric characteristics of the photoconductive layer are readily degraded drastically.

In the process of the present invention, in order for the multi-layer distribution structure to be manifested effectively, it is preferred that water and a water-miscible organic solvent be used at a weight ratio of from 1/1 to 1/10, especially 1/3 to 1/5. As the water-miscible organic solvent, there are preferably employed lower alcohols such as methanol, ethanol and butanol, lower ketones such as acetone and methylethyl ketone, and ethers such as tetrahydrofuran and dioxane.

In order for the multi-layer distribution structure to be manifested effectively, it is preferred that the compositon for formation of an intermediate layer be characterized by a solid content of 5 to 30% by weight, especially 10 to 25% by weight, and a viscosity of 5 to 200 cp, especially 10 to 100 cp, as measured at 18° C.

Various coaters, such as a wire coater, a bar coater, a knife coater and a roller coater may be used for coating the above composition on the surface of the substrate. It is preferred that the amount coated of the intermediate layer be 3 to 20 g/m$^2$, especially 5 to 10 g/m$^2$, as measured after drying.

The coating composition coated on the substrate is then dried to form a multi-layer distribution structure in which a combination of the vinyl acetate polymer and the acrylic resin is predominantly distributed in the surface portion. Also the speed of drying the coated composition is a factor having influences on manifestation of the multi-layer distribution structure. In general, it is preferred that the drying be carried out at a temperature of 40° to 100° C., especially 50° to 70° C., for 10 to 120 seconds, especially 30 to 80 seconds. When an alcohol, ketone or cyclic ether having a boiling point lower than 100° C., formation of the multi-layer distribution structure is further promoted. When the intermediate layer is dried so that the water content is 2 to 7 g/m$^2$, a desirable combination of the electroconductivity and the moisture-resistant adhesion can be obtained.

In accordance with one preferred embodiment of the present invention, 15 to 35% by weight, especially 20 to 30% by weight, of the sum of the vinyl acetate polymer and acrylic resin contained in the intermediate layer is predominantly distributed in the surface portion of the intermediate layer, namely the surface portion falling in contact with the photoconductive layer. Formation of the multi-layer distribution structure can be confirmed by utilizing the fact that the electroconductive resin in the intermediate layer is insoluble in toluene, namely by contacting the intermediate layer with toluene maintained at 15° C. for 30 minutes, measuring the amount coated of the intermediate layer before and after the contact with toluene and calculating the distribution ratio ($R_D$) according to the following formula:

$$R_D = \frac{Q_1 - Q_2}{Q_1 \times C} \times 10{,}000$$

wherein $Q_1$ represents the amount coated (g/m$^2$) of the intermediate layer, $Q_2$ represents the amount coated (g/m$^2$) of the intermediate layer after the contact with toluene, and C denotes the total concentration (%) of the vinyl acetate polymer and acrylic resin in the intermediate layer, namely the value represented by the following formula:

$$\frac{(A) + (B)}{(A) + (B) + (C)} \times 100$$

in which (A) represents the content of the acrylic resin in the intermediate layer, (B) represents the content of the vinyl acetate polymer in the intermediate layer and (C) represents the content of the resinous conducting agent in the intermediate layer.

When the distribution ratio ($R_D$) is lower than 15%, it becomes difficult to form a bonding having a sufficient moisture-resistant adhesion strength between the intermediate layer and the photoconductive layer. If the distribution ratio ($R_D$) is higher than 35%, when an image is formed according to the electrostatic photographic process, fogging or othe trouble is caused and it is difficult to obtain a clear image.

In the intermediate layer of the present invention, since a combination of the vinyl acetate polymer and the acrylic resin is predominantly distributed in the surface portion falling in contact with the photoconductive layer, the resinous conducting agent is predominantly distributed in the opposite surface portion falling in contact with the substrate. Accordingly, when the surface portion in which the combination of the vinyl acetate polymer and the acrylic resin is predominantly distributed is removed from the intermediate layer, the residual intermediate layer has a surface resistivity lower than $1 \times 10^{10}\Omega$, especially lower than $1 \times 10^{8}\Omega$, as measured at a relative humidity of 65%.

In the present invention, as the flexible substrate, there can be used ordinary papers composed of cellulose fibers, such as tissue papers, art papers, coated papers and raw papers for copying sheets, and artificial papers prepared from staples, fleeces and fibrids of synthetic fibers. Prior to formation of the intermediate layer, an electroconductive back coat layer may be formed on one surface of the flexible substrate. Alternately, after formation of the intermediate layer on one surface of the flexible substrate, a back coat layer may be formed on the opposite surface of the flexible substrate. Known electroconductive resin compositions, for example, those shown below, are preferably used for formation of such back coat layer.

| Component | Composition (parts by weight) ordinary range | preferred range |
|---|---|---|
| Resinous conducting agent | 100 | 100 |
| Non-electroconductive resin binder | 0–1000 | 50–500 |
| Water-soluble inorganic salt | 0–30 | 0–10 |
| Organic moisture-absorbing substance | 0–20 | 0–10 |

As the resinous conducting agent, those exemplified hereinbefore are used, and cationic resinous conducting agents are preferably employed. As the non-electroconductive resin binder, there are employed water-soluble resins such as polyvinyl alcohol, starch, cyanoethylated starch, methyl cellulose, ethyl cellulose, polyacrylamide, polyvinyl pyrrolidone and water-soluble acrylic resins.

As the water-soluble inorganic salt, there can be mentioned, for example, halides of alkali metals, alkaline earth metals, zinc, aluminum and ammonium such as sodium chloride, potassium chloride, sodium bromide, potassium bromide, lithium bromide, calcium chloride, barium chloride, magnesium chloride, zinc chloride, aluminum chloride and ammonium chloride, nitrates and nitrites of alkali metals, alkaline earth metals, zinc, aluminum and ammonium such as sodium nitrate, potassium nitrate, sodium nitrite, potassium nitrite, calcium nitrate, barium nitrate, magnesium nitrate, zinc nitrate, aluminum nitrate and ammonium nitrate, sulfates, sulfites and thiosulfates of alkali metals and ammonium such as Glauber salt, potassium sulfate, ammonium sulfate and sodium thiosulfate, carbonates and bicarbonates of alkali metals and ammonium such as sodium carbonate, potassium carbonate and ammonium carbonate, and phosphorus oxyacid salts of alkali metals and ammonium such as sodium orthophosphate and sodium metaphosphate. These inorganic salts may be used singly or in the form of a mixture of two or more of them.

As the organic moisture-absorbing substance, there can be used, for example, water-soluble polyhydric alcohols such as glycerin, diethylene glycol, triethylene glycol, polyethylene glycol, sorbitol, mannitol, pentaerythritol, trimethylol propane and trimethylol ethane, and low-molecular-weight anionic, cationic, amphoteric and non-ionic surface active agents.

The electroconductive resin composition for formation of a back coat layer is coated in the form of an aqueous solution on a flexible substrate in an amount of 2 to 20 g/m$^2$, especially 5 to 15 g/m$^2$ (as measured after drying).

According to the present invention, a composition formed by dispersing a fine powder of a photoconductor in a solution of an electrically insulating resin in an aromatic solvent is coated on the intermediate layer having the above-mentioned multi-layer distribution structure, and is then dried to bond both layers tightly.

As the photoconductor, there are employed inorganic photoconductors capable of being rendered hydrophilic by the etching treatment, especially photoconductive zinc oxide, titanium dioxide and lead oxide. As the electrically insulating resin, there are employed resin binders having a volume resistivity higher than $10\times10^{14}\Omega$-cm, for example, hydrocarbon polymers such as polyolefins polystyrene and styrene-butadiene copolymers, vinyl polymers such as vinyl acetate-vinyl chloride copolymers, acrylic resins such as polyacrylic acid esters, and alkyd, melamine, epoxy and silicone resins. Combinations and recipes of these photoconductors and resin binders are well known in the art, and any of known combinations and known recipes can be used in the present invention.

Typical instances of the coating composition for formation of the photoconductive layer are as follows:

| Component | Composition (parts by weight) | |
|---|---|---|
| | Ordinary Range | Preferred Range |
| Photoconductor | 100 | 100 |
| Resin binder | 10–40 | 20–25 |
| Photosensitizer | 0.005–0.5 | 0.01–0.3 |
| Memory eraser | 0–0.01 | 0–0.005 |
| Moisture proofing agent | 0–1.0 | 0–0.5 |

As the photosensitizer, there are employed Rose Bengale, Bromophenol Blue and the like, and as the memory eraser, there are employed sodium dichromate, ammonium dichromate, potassium permanganate. As the moisture proofing agent, there are used cobalt naphthenate, manganese naphthenate and the like.

The so formed composition is coated in the form of a solution or dispersion in an aromatic solvent such as benzene, toluene, xylene or the like on the intermediate layer in an amount of 10 to 30 g/m$^2$, especially 15 to 25 g/m$^2$, as measured after drying, and the coated composition is then coated. Since a combination of the vinyl acetate polymer and the acrylic resin is predominantly distributed in the surface layer of the intermediate layer, a tight bonding is attained between this surface portion of the intermediate layer and the photoconductive layer-forming composition coated thereon.

The electrophotographic photosensitive material of the present invention may be formed into a plate for offset printing or lithography according to the known electrophotographic process and the known etching operation. More specifically, the photoconductive layer of the electrophotographic photosensitive material is charged with static electricity of a certain polarity by corona discharge or the like and is then subjected to imagewise exposure through an image to be printed, to form an electrostatic latent image on the photoconductive layer. This electrostatic latent image is developed with a known developer for electrophotograhy and if desired, the developed image is fixed, whereby a toner image is formed. As the developer, there are employed known liquid developers and powdery developers. Fixation of the powdery developer can be accomplished by heat-fusion or pressure fixation methods.

A known etching solution is coated on the surface of the photoconductive layer on which a toner image corresponding to the image to be printed has been formed, to render hydrophilic the non-image area, namely the background, of the photoconductive layer, whereby an oleophilic ink-supporting portion consisting of the toner image area and a hydrophilic ink-repelling portion consisting of the etched photoconductive layer are formed.

The electrophotographic photosensitive material of the present invention has a prominent advantage that a sharp and clear toner image having a high contrast can be formed well in agreement with an image to be printed by using a one-component type magnetic toner (carrier-less magnetic toner), for example, a magnetic toner comprising 100 parts by weight of triiron tetroxide and/or $\gamma$-type diiron trioxide, 10 to 150 parts by weight of a binder and 0 to 30 parts by weight of carbon black. When this toner is employed, there is attained a prominent advantage that since an iron oxide-containing toner image is formed, the property of absorbing and holding an oily ink in the image area can be remarkably enhanced. As the binder, there are employed various waxes, resins and rubbers or mixtures thereof. In general, it is preferred that a mixture comprising a wax and a resin at a weight ratio of from 1/19 to 1/2 to be used as the binder.

It is preferred that the toner image be fixed by using a press roller having a linear compression pressure of at least 15 Kg per cm of the roller length, especially at least 30 Kg per cm of the roller length. When fixing is carried out by using such press roller, the following advantages can be attained:

(1) Toner particles are embedded in the photoconductive layer, and even if the amount of an oily ink to be applied to the printing plate is increased, the ink is prevented from being applied to the plate surface in the excessively bulging state and being transferred to a paper or blanket roller in such state. Accordingly, a printed image having a high image density can be conveniently obtained without reduction of the resolving power.

(2) The surface of the photoconductive layer is remarkably smoothened and made compact by the press roller, and therefore, contamination of the background caused by the surface roughening at the etching step can be effectively prevented. By virtue of this improvement of the surface condition and the above-mentioned improvement of the moisture-resistant adhesion, the resistance to the printing operation and the durability of the resulting printing plate can be further enhanced.

The etching treatment can easily be accomplished by treating the photoconductive layer at a temperature of 0° to 50° C. for 1 to 10 seconds by using an aqueous solution containing 10 to 20% by weight of an ammonium or alkali metal salt of a polybasic carboxylic acid or an alkali metal salt of phosphoric acid.

The present invention will now be described in detail by reference to the following Examples that by no means limit the scope of the invention.

COMPARATIVE EXAMPLE 1

Electrophotographic photosensitive materials having an intermediate layer indicated in Table 1 were prepared in manners described in Examples given hereinafter, and general properties, copying properties and resistance to the printing operation of the so prepared electrophotographic photosensitive materials were tested according to methods described hereinafter to obtain results shown in Table 2.

The resins used for preparation of the intermediate layer are as follows:

(1) Acrylic Resin: Jurymer AT-510 manufactured by Nippon Junyaku Kabushiki Kaisha (2) Vinyl Acetate Resin: Vinylol S manufactutred by Showa Kobunshi Kabushiki Kaisha (3) Electroconductive Resin: E-27S manufactured by Toyo Ink Kabushiki Kaisha The test methods adopted are as follows:

(A) General Properties (1) Bonding strength between photoconductive layer and intermediate layer:

The bonding strength was evaluated collectively based on results of the nail scratching test, the pencil hardness test and the bending test according to the following scale:

○: good (pencil hardness higher than 2H)
Δ: relatively good (pencil hardness of B to 2H)
X: bad (pencil hardness lower than B)

(2) Water resistance of intermediate layer:

The sample was dipped in water for 30 minutes and the state of peeling of the photoconductive layer from the intermediate layer was examined. The water resistance of the intermediate layer was evaluated according to the following scale:

○: photoconductive layer was not peeled
Δ: photoconductive layer was peeled when it was pressed strongly with a finger
X: photosensitive layer was peeled

(B) Copying Properties (1) Fogging (spot-like contamination on the background):

The copying operation was carried out by using an electrophotographic copying machine (Copystar 900D manufactured by Mita Industrial Company Limited), and roughening of the background (fogging of the background) was examined and evaluated according to the following scale:

○: no substantial fogging
Δ: some fogging
X: conspicuous fogging (2) Image quality:

The uniformity and resolving power of an image obtained by conducting the copying operation by using the above-mentioned Copystar 900D were examined, and the image quality was evaluated according to the following scale:

○: image was uniform and had a resolving power higher than 5 lines per mm
Δ: image was slightly inferior in the uniformity and had a resolving power of 3 to 5 lines per mm
X: image was much inferior in the uniformity and had a resolving power lower than 3 lines per mm.

(C) Resistance to Printing Operation (1) Number of printed copies:

Printing was conducted continuously by using an offset printing machine (Model 1010 manufactured by Ricoh Kabushiki Kaisha), and the resistance to the printing operation was evaluated based on the number of prints obtained before the photoconductive layer of the master was peeled or wrinkled.

Table 1

| | Composition (parts by weight) of Intermediate Layer | | | Composition (solid ratio) of Intermediate Layer | | |
|---|---|---|---|---|---|---|
| Sample | Acrylic Resin (solid content = 30%) | Vinyl Acetate Resin (degree of polymerization = 500, solid content = 48%) | Electroconductive Resin (solid content = 45%) | Acrylic Resin | Vinyl Acetate Resin | Electroconductive Resin |
| Comparative Sample A | 60 | 0 | 20 | 2 | 0 | 1 |
| Sample 1 of Present Invention | 67 | 4 | 24 | 20 | 2 | 11 |
| Sample 2 of Present Invention | 70 | 6 | 27 | 7 | 1 | 4 |
| Sample 3 of Preosent Invention | 65 | 10 | 23 | 8 | 2 | 5 |
| Comparative Sample B | 65 | 20 | 34 | 4 | 2 | |
| Comparative Sample C | 0 | 60 | 32 | 0 | 2 | 1 |

Table 2

| | General Properties | | Copying Properties | | Resistance to Printing Operation |
|---|---|---|---|---|---|
| Sample | Bonding Strength | Water Resistance | Fogging | Image Quality | (number of prints) |
| Comparative Sample A | × | × | ○ | ○ | |
| Sample 1 of | Δ | ○ | ○ | ○ | |

Table 2-continued

| Sample | General Properties: Bonding Strength | General Properties: Water Resistance | Copying Properties: Fogging | Copying Properties: Image Quality | Resistance to Printing Operation (number of prints) |
|---|---|---|---|---|---|
| Present invention Sample 2 of Present Invention | ○ | ○ | ○ | ○ | |
| Sample 3 of Present Invention | ○ | ○ | Δ | ○ | |
| Comparative Sample B | ○ | ○ | × | × | |
| Comparative Sample C | ○ | ○ | × | × | |

From the results shown in Table 2, the following can be seen.

In case of comparative sample A in which no vinyl acetate resin is incorporated in the intermediate layer, the acrylic resin and electroconductive resin are homogeneously distributed in the intermediate layer, and therefore, the bonding strength is not improved and the water resistance is poor. Accordingly, the resistance to the printing operation is very low.

In case of samples 1, 2 and 3 of the present invention in which the vinyl acetate resin is incorporated in the intermediate layer, since the vinyl acetate resin and acrylic resin are predominantly distributed in the surface portion of the intermediate layer (the vinyl acetate resin is more predominantly distributed), the surface portion of the intermediate layer is dissolved by toluene contained in the photoconductive layer-forming coating composition and is included in the coating composition. Accordingly, the bonding strength between the intermediate layer and the photoconductive layer is enhanced, and also the resistance to the printing operation is enhanced.

In case of comparative sample B in which the vinyl acetate resin is incorporated in the intermediate layer in too large an amount and comparative sample C in which the intermediate layer is composed solely of the vinyl acetate resin and the electroconductive resin, since the surface portion of the intermediate layer is dissolved in too large an amount by toluene contained in the photoconductive layer-forming coating composition, the balance between zinc oxide and resins (the mixing ratio and the like) is lost, and the quality of the copied image is degraded.

COMPARATIVE EXAMPLE 2

Electrophotographic photosensitive materials were prepared in the same manner as sample 3 of the present invention was prepared in Comparative Example 1 except that the degree of polymerization was changed as indicated in Table 3. Properties were tested in the same manner as described in Comparative Example 1 to obtain results shown in Table 3.

Table 3

| Sample | Degree of Polymerization of Vinyl Acetate Resin | General Properties: Bonding Strength | General Properties: Water Resistance | Copying Properties: Fogging | Copying Properties: Image Quality | Resistance to Printing Operation (number of prints) |
|---|---|---|---|---|---|---|
| Sample 4 of Present Invention | 100 | Δ | ○ | ○ | ○ | 1000 |
| Sample 5 of Present Invention | 500 | ○ | ○ | ○ | ○ | 1200 |
| Sample 6 of Present Invention | 1000 | ○ | ○ | ○ | ○ | 1200 |
| Sample 7 of Present Invention | 1700 | ○ | ○ | ○ | Δ | 1000 |
| Comparative Sample D | 1900 | Δ | Δ | Δ | × | 800 |

EXAMPLE 1

A dispersion of composition 1—1 indicated below was coated by a wire bar of No. 20 on one surface of a both surface-coated paper having a thickness of 95μ and was dried at 80° C. for 1 minute to form an intermediate layer. The amount coated of the intermediate layer was 6.0 g/m$^2$.

| Composition 1-1 | |
|---|---|
| Water-soluble acrylic resin (Jurymer AT-510 manufactured by Nippon Junyaku Kabushiki Kaisha; solid content = 30%) | 70 parts by weight |
| Vinyl acetate resin (Vinylol S manufactued by Showa Kobunshi Kabushiki Kaisha; polymerization degree = 500, solid content = 48%) | 7 parts by weight |
| Electroconductive resin (E-27S manufactured by Tokyo Ink Kabushiki Kaisha; solid content = 45%) | 7 parts by weight |
| Methanol | 160 parts by weight |

A dispersion of composition 1-2 indicated below was coated by a wire bar of No. 20 on the surface opposite to the surface on which the intermediate layer had been formed and was dried at 80° C. for 1 minute to form a back coat layer. The amount coated of the back coat layer was 5.0 g/m$^2$.

| Composition 1-2 | |
|---|---|
| Water-soluble acrylic resin (Jurymer AT-510 same as used in composition 1-1) | 60 parts by weight |
| Carbon black (Corax L manufactured by Degussa Inc.) | 9 parts by weight |
| Electroconductive resin (E-27S | 26 parts by weight |

-continued

| Composition 1-2 | |
|---|---|
| same as used in composition 1-1 | |
| methanol | 190 parts by weight |

A dispersion of composition 1-3 indicated below for formation of a photoconductive layer was coated on the surface of the intermediate layer of the treated paper and was dried at 120° C. for 2 minutes to obtain an electrophotographic photosensitive paper for offset printing. The amount coated of the photoconductive layer was 17 g/m$^2$.

| Composition 1-3 | |
|---|---|
| Zinc oxide (Sox-500 manufactured by Seido Kagaku Kabushiki Kaisha) | 180 parts by weight |
| Acrylic resin (LR-018 manufactured by Mitsubishi Rayon Kabushikia Kaisha; solid content = 40%) | 15 parts by weight |
| Rose Bengale (1% solution in methanol) | 7 parts by weight |
| Toluene | 260 parts by weight |

The so prepared electrophotographic photosensitive paper was allowed to stand at a temperature of 20° C. and a relative humidity of 65% for 24 hours in the dark, and then it subjected to the copying operation using a dry-type electrophotographic copying machine (Copystar 900D manufactured by Mita Industrial Company Limited; one-component type magnetic toner being used). A clear and sharp image free of contamination on the background was obtained. When this photosensitive paper was used as a plate for offset printing (offset printing machine, Model 1010 manufactured by Ricoh Kabushiki Kaisha being employed), even after printing of 1000 sheets the plate was not wrinkled or peeled and prints having good quality could be obtained.

EXAMPLE 2

A dispersion of composition 2-1 indicated below was coated by a wire bar of No. 20 on one surface of a both surface-coated paper having a base weight of 104 g/m$^2$ and was dried at 80° C. for 1 minute to form an intermediate layer. The amount coated of the intermediate layer was 4.0 g/m$^2$.

| Composition 2-1 | |
|---|---|
| Water-soluble acrylic resin (same as used in composition 1-1) | 84 parts by weight |
| Vinyl acetate resin [Gosenyl M-50 (Y-5) manufactured by Nippon Gosei Kagaku Kabushiki Kaisha; polymerization degree = 1100; solid content = 50%] | 6 parts by weight |
| Electroconductive resin (PQ-10 manufactured by Soken Kagaku Kabushiki Kaisha; solid content | 27 parts by weight |
| Methanol | 150 parts by weight |

A dispersion of composition 2—2 indicated below for formation of a back coat layer was coated by a wire bar of No. 20 on the surface opposite to the surface on which the intermediate layer had been formed and was dried at 80° C. for 1 minute to form a back coat layer. The amount coated of the back coat layer was 4.7 g/m$^2$.

| Composition 2-2 | |
|---|---|
| Water- and methanol-soluble nylon resin (Toresin M-20 manufactured by Teikoku Kagaku Sangyo Kabushiki Kaisha; solid content = 20%) | 72 parts by weight |
| Silica (Syloid 244 manufactured by Fuji-Davison Kagaku Kabushiki Kaisha) | 5 parts by weight |
| Electroconductive resin (ECR 34 manufactured by Dow Chemical Co. Ltd.; solid content = 33.5%) | 43 parts by weight |
| methanol | 140 parts by weight |

A dispersion of composition 2-3 indicated below for formation of a photoconductive layer was coated on the surface of the intermediate layer of the treated paper and was dried at 120° C. for 2 minutes to form a photographic photosensitive layer for offset printing. The amount coated of the photoconductive layer was 20 g/m$^2$.

| Composition 2-3 | |
|---|---|
| Zinc oxide (Saze # 4000 manufactured by Sakai Kagaku Kab shiki Kaisha) | 180 parts by weight |
| Alkyd resin (Beckosol 1341 manufactured by Dainippon Ink Kagaku Kogyo Kabushiki Kaisha; Gosei solid content = 50%) | 72 parts by weight |
| Rose Bengale (1% solution in methanol) | 6 parts by weight |
| Sodium dichromate (0.1% solution in methanol) | 5 parts by weight |
| Toluene | 200 parts by weight |

The so obtained electrophotographic photosensitive paper for offset printing was allowed to stand at a temperature of 20° C. and a relative humidity of 65% for 24 hours in the dark, and it was then subjected to the copying operation using a dry-type electrophotographic copying machine (Copystar 350D manufactured by Mita Industrial Company Limited; one-component type magnetic toner being used). A clear and sharp image free of fogging on the background was obtained. When this photosensitive paper was used as a plate for offset printing (offset printing machine Model AM-240 manufactured by Addressograph Multigraph Co. being used), even after printing of 1500 sheets the photosensitive plate was not wrinkled or peeled and prints having good quality could be obtained.

EXAMPLE 3

A dispersion of composition 3-1 indicated below was coated on one surface of a wet-strength paper having a base weight of 95 g/m$^2$ so that the amount coated was 15 g/m$^2$, and was dried at 80° C. for 2 minutes to form an intermediate layer.

| Composition 3-1 | |
|---|---|
| Water-soluble acrylic resin (same as used in composition 1-1) | 80 parts by weight |
| Vinyl acetate resin[Gohsenyl M-70 (Z-4) manufactured by Nippon Gosei Kagaku Kabushiki Kaisha; polymerization degree = 170; solid content = 70%] | 7 parts by weight |
| Electroconductive resin (same | 35 parts by weight |

-continued

| Composition 3-1 | |
|---|---|
| as used in composition 1-1) | |
| Methanol | 180 parts by weight |

A dispersion of composition 3-2 indicated below was coated in an amount coated of 13 g/m$^2$ on the surface opposite to the surface on which the intermediate layer had be formed and was dried at 80° C. for 2 minutes to form a back coat layer.

| Composition 3-2 | |
|---|---|
| Water- and methanol-soluble nylon resin (same as used in composition 2-2) | 80 parts by weight |
| Silica (same as used in composition 2-2) | 5 parts by weight |
| Electroconductive resin (Colorfax ECA manufactured Imperial Chemical Co.; solid content = 33.3%) | 45 parts by weight |
| Methanol | 150 parts by weight |

The so coated paper was subjected to the super calender treatment to obtain a smoothened electroconductive support. Then, a dispersion of composition 3-3 indicated below was coated and dried at 120° C. for 2 minutes to form an electrophotographic photosensitive paper. The amount coated of the so formed electroconductive layer was 18 g/m$^2$.

| Composition 3-3 | |
|---|---|
| Zinc oxide (same as used in composition 1-3) | 180 parts by weight |
| Acrylic resin (LR-188 manufactured by Mitsubishi Rayon Kabushiki Kaisha; solid conent = 40%) | 100 parts by weight |
| Bromophenol Blue (1% solution in methanol) | 5 parts by weight |
| Toluene | 250 parts by weight |

The so obtained electrophotographic photosensitive paper for offset printing was allowed to stand at a temperature of 20° C. and a relative humidity of 65% for 24 hours in the dark and was subjected to the copying operation by using the same copying machine as used in Example 1 (a one-component type magnetic toner being used). A clear and sharp image free of contamination on the background was obtained. When this photosensitive paper was used as an offset printing plate by employing the same offset printing machine as used in Example 1, even after printing of 1000 sheets the photosensitive plate was not wrinkled or the electroconductive layer was not peeled. Obtained prints were found to have a good quality.

EXAMPLE 4

An electrophotographic photosensitive paper for offset printing was prepared in the same manner as described in Example 1 except that the following compositions were used for formation of an intermediate layer and a back coat layer.

| Composition 4-1 (Dispersion for Formation of Intermediate Layer) | |
|---|---|

-continued

| | |
|---|---|
| Water-soluble styrene-maleic acid copolymer resin (Stylite CM-3 manufactured by EC Kagaku Kabushiki Kai sha; solid content = 40%) | 60 parts by weight |
| Vinyl acetate resin (same as used in composition 1-1) | 8 parts by weight |
| Electroconductive resin (same as used in composition 2-2) | 1 parts by weight |
| methanol | 180 parts by weight |

| Composition 4-2 (Dispersion for Formation of Back Coat Layer) | |
|---|---|
| Vinyl acetate resin (same as used in composition 2-1) | 40 parts by weight |
| Silica (same as used in composition 2-2) | 6 parts by weight |
| Electroconductive resin (same as used in composition 1-1) | 30 parts by weight |
| Methanol | 230 parts by weight |

An image having the same good quality as that of the image obtained in Example 1 was obtained from the so prepared photosensitive paper, and the resistance to the printing operation was more than 1000 sheets.

What we claim is:

1. An electrophotographic photosensitive material suitable for offset printing and lithography comprising a flexible substrate, an electroconductive back coat layer formed on one surface of the substrate, an electroconductive intermediate layer formed on the other surface of the substrate and a photoconductive layer formed on the intermediate layer, said photoconductive layer being composed of a fine powder of an inorganic photoconductor capable of being rendered hydrophilic by an etching treatment, dispersed in an electrically insulating resin, wherein said intermediate layer is composed of a composition comprising (A) an acrylic resin which is water-soluble only when it is neutralized with an alkaline substance, (B) a vinyl acetate polymer having a degree of polymerization of 100 to 1700 and (C) a cationic polymeric conducting agent, in said composition the weight ratio of acrylic resin (A)/vinyl acetate polymer (B) is in the range of 4/1 to 10/1 and the amount of the conducting agent (C) is 20 to 100 parts by weight per 100 parts by weight of the sum of the components (A) and (B), said intermediate layer has such a multilayer distribution structure that a combination of the vinyl acetate polymer and the acrylic resin is predominantly distributed in the surface portion falling in contact with the photoconductive layer, and the photoconductive layer is bonded to the intermediate layer through said surface portion.

2. A photosensitive material as set forth in claim 1 wherein the acrylic resin is a copolymer having an acid value of at least 39, which is composed of (i) at least one ethylenically unsaturated carboxylic acid and (ii) at least one monomer selected from the group consisting of esters of ethylenically unsaturated carboxylic acids and olefinic hydrocarbons.

3. A photosensitive material as set forth in claim 2 wherein the acrylic resin is a copolymer of acrylic acid, ethyl acrylate and methyl methacrylate.

4. A photosensitive material as set forth in claim 2 wherein the acrylic resin is a copolymer of maleic acid and styrene.

5. A photosensitive material as set forth in claim 1 wherein the cationic conducting agent is an acrylic resin having a quaternary ammonium group.

6. A photosensitive material as set forth in claim 1 wherein the cationic conducting agent contains a quaternary ammonium group at a concentration of 200 to 1400 meq per 100 g of the polymer.

7. A photosensitive material as set forth in claim 1 wherein the acrylic resin (A) and the vinyl acetate resin (B) are present in the intermediate layer at an (A)/(B) weight ratio of from 5/1 to 8/1.

8. A photosensitive material as set forth in claim 1 wherein 15 to 35% by weight of the sum of the acrylic resin and the vinyl acetate resin in the intermediate layer is predominantly distributed in the surface portion falling in contact with the photoconductive layer.

9. A photosensitive material as set forth in claim 1 wherein the intermediate layer is formed on the substrate in an amount coated of 3 to 20 $g/m^2$.

10. A photosensitive material as set forth in claim 1 wherein the inorganic photoconductor is selected from the group consisting of zinc oxide, titanium dioxide and lead oxide.

11. A photosensitive material as set forth in claim 1 wherein when the surface layer in which the combination of the acrylic resin and the vinyl acetate polymer is predominantly distributed is separated from the intermediate layer, the intermediate layer has a surface resistivity not higher than $1 \times 10^{10}\Omega$ as measured at a relative humidity of 65%.

* * * * *